United States Patent [19]

Jerue

[11] Patent Number: 4,725,186

[45] Date of Patent: Feb. 16, 1988

[54] LIFT TRUCK WITH VACUUM LOAD-SUPPORTING ASSEMBLY

[75] Inventor: Edward A. Jerue, Montgomery, Mass.

[73] Assignee: Laminated Papers, Inc., Holyoke, Mass.

[21] Appl. No.: 862,666

[22] Filed: May 13, 1986

[51] Int. Cl.[4] ..... B25G 15/06

[52] U.S. Cl. ..... 414/627; 414/620

[58] Field of Search ..... 414/620, 627; 294/64.1, 294/65, 88

[56] References Cited

U.S. PATENT DOCUMENTS

| | | | |
|---|---|---|---|
| 2,807,382 | 9/1957 | Schenkelberger | 414/620 |
| 2,932,419 | 4/1960 | Harris | 414/620 |
| 2,942,745 | 6/1960 | Horton | 414/627 |
| 3,040,920 | 6/1962 | Harris | 414/627 X |
| 3,147,872 | 9/1964 | Olson | 414/627 X |
| 3,207,348 | 9/1965 | Olson | 414/627 |
| 3,227,299 | 1/1966 | Draxler | 414/627 X |
| 3,227,482 | 1/1966 | Harris et al. | 414/627 X |
| 3,260,392 | 7/1966 | Harris | 414/620 |
| 3,376,061 | 4/1968 | Harris et al. | 414/627 X |
| 3,923,177 | 12/1975 | Horton | 414/627 |

*Primary Examiner*—Dave W. Arola

*Attorney, Agent, or Firm*—Schiller, Pandiscio & Kusmer

[57] ABSTRACT

An improved lift truck for transporting a load is described. The improved truck comprises: a frame; a plurality of rotatable wheels coupled to the frame; a mast secured to the frame; a carriage secured to and movable relative to the mast; load engagement means secured to and movable with the carriage relative to the mast for engaging and holding the load, the load engagement means including vacuum pad means and pneumatic switching means, the vacuum pad means being configured and the pneumatic switching means being positioned so that when the vacuum pad means is moved into contact with and engages the load so as to activate the pneumatic switching means a vacuum coupling is created between the vacuum pad means and the load, the vacuum coupling being of sufficient strength so as to permit the vacuum pad means to support the weight of the load; vacuum pump means secured to the truck for selectively creating a vacuum pressure sufficient to provide the vacuum coupling; and hose assembly means for pneumatically coupling the vacuum pad means with the vacuum pump means, the hose assembly comprising a flexible hose extending between the vacuum pump means and the vacuum pad means, the flexible hose having a first end in pneumatic communication with the vacuum pump means and a second end in pneumatic communication with the vacuum pad means and hose tensioner means for engaging the flexible hose so as to prevent slack from developing in the hose as the carriage is moved relative to the mast.

18 Claims, 4 Drawing Figures

LIFT TRUCK WITH VACUUM LOAD-SUPPORTING ASSEMBLY

This invention relates generally to lift trucks, particularly adapted for industrial operations and, more particularly, to lift trucks having a loadsupporting assembly for vacuum supporting a load, such as heavy paper rolls.

Lift trucks having suction or vacuum loadsupporting assemblies in the form of front-end vacuum pad assemblies, for use in transporting heavy loads, such as paper rolls, are well-known. See, for instance, U.S. Pat. Nos. 3,147,872, 3,207,348, 3,227,482, 3,260,392 and 3,376,061. The lift trucks of this type usually include a mast provided at the front of the truck. The vacuum pad assembly is adapted to move up and down the mast in response to the operator's controls. To transport a load, the operator adjusts the height of the vacuum pad assembly before moving the vacuum pad assembly into contact with the load. The operator then actuates the vacuum system so as to draw a vacuum through the pad assembly of sufficient strength to support the weight of the load. With a separate operator control, the load is raised above the ground by moving the vacuum pad assembly and load up the mast. The vacuum pad assembly usually includes a vacuum seal member so as to ensure a substantially air-tight seal between the vacuum pad assembly and load.

In the prior art devices, an undesirable lag typically exists between the time vacuum is applied to the vacuum pad assembly and when a sufficient negative pressure is generated to raise and transport the load. This lag exists because it takes the vacuum pump a period of time to evacuate the atmospheric gases trapped in the cavity enclosed by the vacuum seal between the vacuum pad assembly and the load and in the hose assembly between the pump and the vacuum pad assembly. If the operator attempts to lift the load prematurely, there is a chance that the load will drop, posing a threat of damage to the load and danger to personnel. It is desirable to substantially reduce this time lag so as to increase the speed of the transporting operation and prevent the unsafe lifting condition that occurs when insufficient vacuum coupling exists between vacuum pad assembly and load.

To minimize this lag time, the vacuum pumps typically used in known lift trucks are usually operated continuously. Such continuous operation tends to reduce the operating life of the vacuum pump, thereby adding to the maintenance and operational costs of the truck.

In addition to the above-noted problems, several disadvantages exist in some of the prior art hose assemblies coupling the vacuum pump to the vacuum pad assembly. More specifically, one such hose assembly shown in U.S. Pat. Nos. 3,147,872 and 3,207,348, includes a long flexible hose extending from the pump, over a take up sheave mounted on the mast, and then downwardly where it is connected to the front end vacuum pad assembly. As the vacuum pad assembly is moved up the mast the tension in the hose is reduced, resulting in poor tracking of the hose in the sheave and the possibility of the hose catching in the mast and front end structure when the vacuum pad assembly is moved back down the mast. Accordingly, one prior art approach for providing uniform tension on the hose so that it will properly track, as well as stay free of the moving elements, includes the use of a heavy counterweight to tension the hose. However, the counterweight tends to either bind on or bang about the ways on which the counterweight is slidably mounted as tension is applied to and released from the hose with movement of the vacuum pad assembly. Further, the counterweight and the hose assembly are usually positioned on the lift truck in a manner tending to restrict the visibility of the operator.

An additional problem of the prior art trucks is that the solenoids, check valves, and other elements of the vacuum supply system, typically employed in known lift trucks, have a tendency to malfunction over time due to the accumulation of foreign matter drawn into the vacuum airstream through the orifices in the vacuum pad. Because of the dusty environment in which suction lift trucks are commonly operated, particularly in paper warehouses, such entrainment of foreign matter tends to cause chronic and costly breakdowns.

It is a general object of the present invention to substantially reduce or overcome the above-noted problems of the prior art.

It is another object of the present invention to provide a lift truck having an improved vacuum system for quickly delivering and maintaining a vacuum to the front end vacuum pad assembly so as to (a) reduce the lag time required to establish a sufficient vacuum coupling between the vacuum pad assembly and the load and (b) hold the load when it is lifted and transported.

Another object of the present invention is to provide a lift truck with an improved vacuum system for providing a fast response time to build sufficient negative pressure between the vacuum pad assembly and the load without the need to operate the vacuum pump continuously.

And another object of the present invention is to provide a vacuum lift truck having a vacuum supply system capable of providing a negative pressure at the vacuum pad substantially instantaneously upon engagement of the vacuum pad with the load, without any overt act by the lift truck operator other than engaging the vacuum pad assembly with the load.

Yet another object of the present invention is to provide a vacuum lift truck in which the vacuum pump is only activated when the negative pressure in the vacuum system drops below a first threshold level and in which the vacuum pump is deactivated when the negative pressure exceeds a second threshold level.

Still another object of the present invention is to provide a lift truck of the type including a vacuum pad assembly having an improved hose assembly and hose tensioner that does not require a heavy counterweight and that provides better visibility for the operator.

These and other objects are achieved by an improved lift truck for transporting a load. The improved truck comprises:

a frame;

a plurality of rotatable wheels coupled to the frame;

a mast secured to the frame;

a carriage secured to and movable relative to the mast;

load engagement means secured to and movable with the carriage relative to the mast for engaging and holding the load, the load engagement means including vacuum pad means and pneumatic switching means, the vacuum pad means being configured and the pneumatic switching means being positioned so that when the vacuum pad means is moved into contact with and engages the load so as to activate the pneumatic switching means a vacuum coupling is created between the vacuum pad means and the load, the vacuum coupling being of sufficient strength so as to permit the vacuum pad means to support the weight of the load;

vacuum pump means secured to the truck for selectively creating a vacuum pressure sufficient to provide the vacuum coupling; and hose assembly means for pneumatically coupling the vacuum pad means with the vacuum pump means, the hose assembly comprising a flexible hose extending between the vacuum pump means and the vacuum pad means, the flexible hose having a first end in pneumatic communication with the vacuum pump means and a second end in pneumatic communication with the vacuum pad means and hose tensioner means for engaging the flexible hose so as to prevent slack from developing in the hose as the carriage is moved relative to the mast.

Other objects of the invention will in part be obvious and will in part appear hereinafter. The invention, accordingly, comprises the apparatus possessing the construction, combination of elements, and arrangement of parts which are exemplified in the following detailed disclosure, and the scope of the application of which will be indicated in the claims.

For a fuller understanding of the nature and objects of the present invention, reference should be had to the following detailed description taken in connection with the accompanying drawings wherein.

Figure 1:
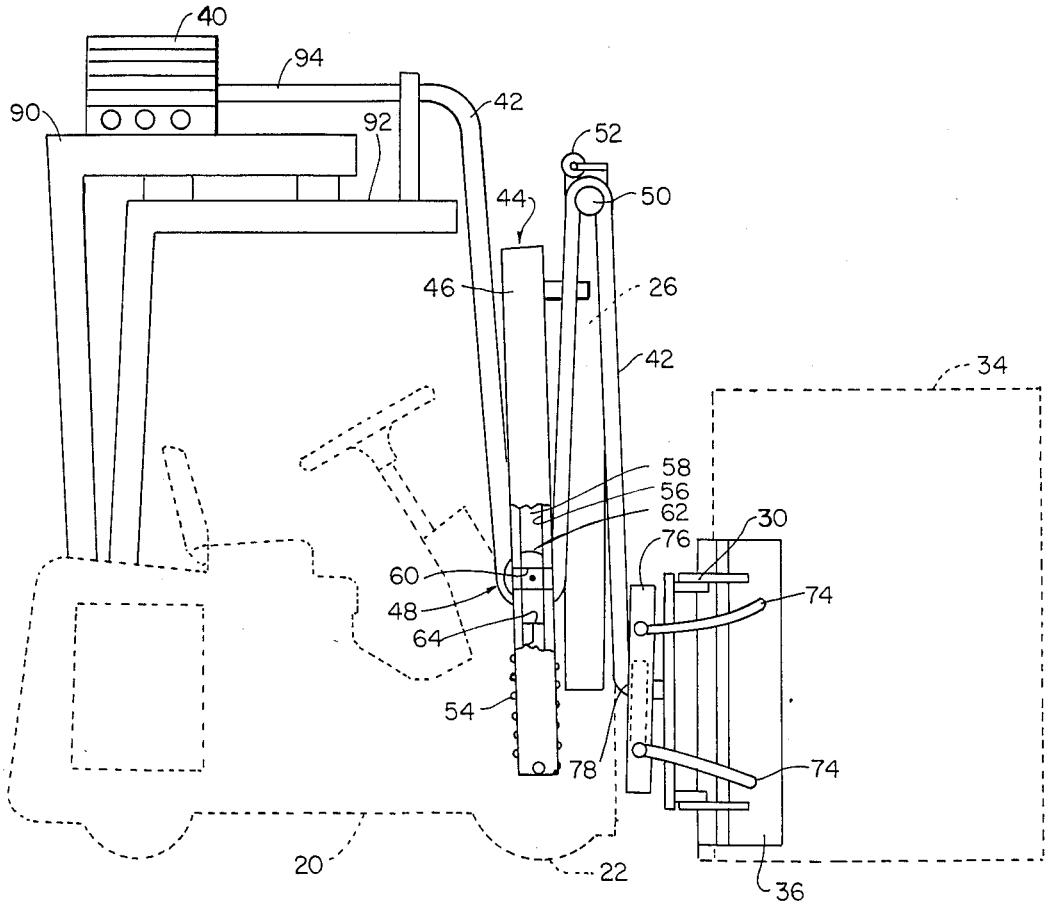
FIG. 1 is a side elevational view, partially broken away, of the preferred embodiment of the lift truck of the present invention.
Figure 2:
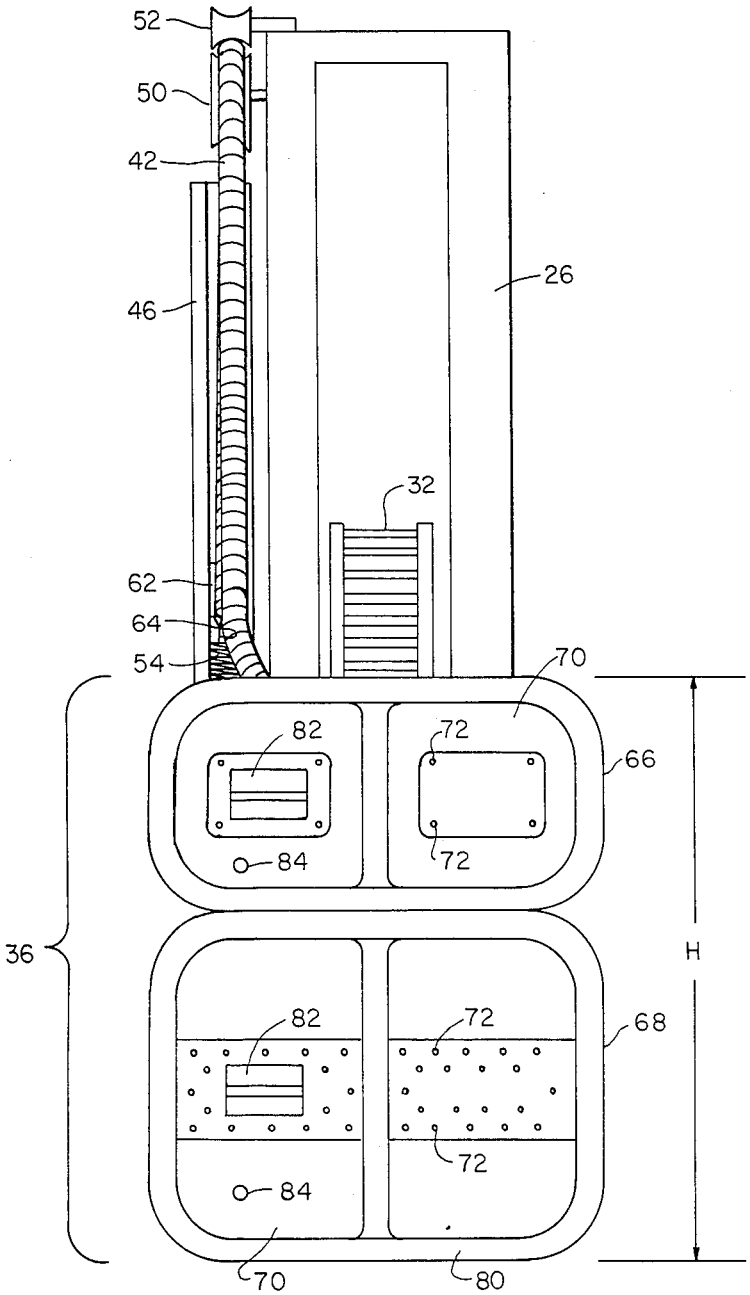
FIG. 2 is a front elevational view of the vacuum pad assembly mast and hose tensioner assembly of the truck shown in FIG. 1.
Figure 3:
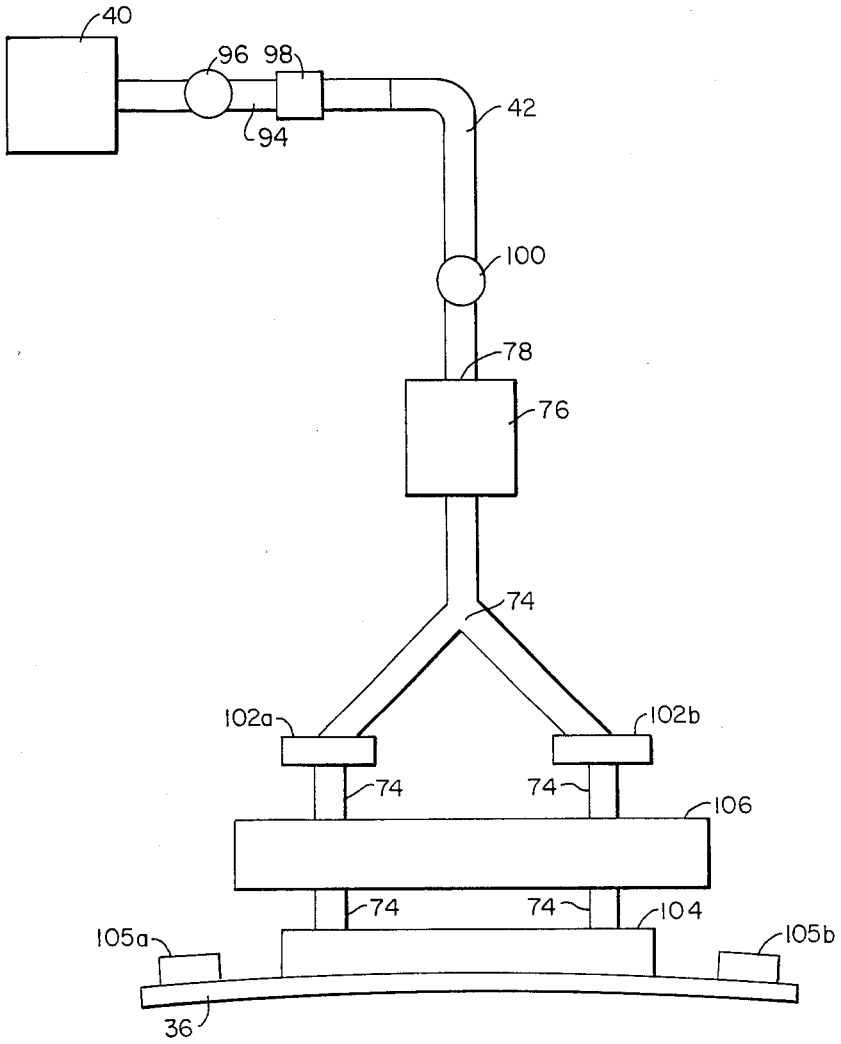
FIG. 3 is a schematic view of the pneumatic system of the truck in FIG. 1.

The preferred embodiment of the lift truck is similar to the one disclosed in U.S. Pat. No. 3,147,872, except that it has been modified in accordance with the present invention. Referring to FIGS. 1 and 2, generally, the truck comprises a body or frame 20. Body 20 rotatably supports wheels 22, which in turn are driven by the motor 24, the latter being supported by the body. Mast 26 is secured to the front end of body 20. A carriage assembly 30 is mounted to mast 26 for reciprocal vertical movement along the length of the mast. The carriage assembly is suitably connected to a chain drive 32 (FIG. 2), which in turn is driven by an operator controlled hydraulic system (not shown) for moving the carriage assembly in either direction on the mast 26. The hydraulic system is similar to the one described in the aforementioned U.S. Pat. No. 3,147,872. The load engagement means includes the vacuum pad assembly 36 coupled to carriage assembly 30 for movement therewith. A pneumatic system for supplying a vacuum for supporting the roll 34, shown in greater detail in FIG. 3, is provided for drawing air through the vacuum pad assembly so as to create a negative pressure of sufficient strength to support the weight of the load. The vacuum supply is provided by a vacuum pump 40 (FIG. 1), the pump being coupled to the vacuum pad assembly 36 through the hose 42 (FIG. 2). To the extent thus far described, the present truck is the same as the prior art truck shown in U.S. Pat. No. 3,147,872. Although not shown, as suggested in the prior art, the mast may be pivotally mounted to the front end of body 20, while the vacuum pad assembly 36 can be mounted to be selectively reciprocally rotated within a substantial vertical plane by the operator at least 90°, as desired.

In accordance with one aspect of the present invention, hose 42 is provided in the form of an accordian-like spring hose which, when stretched, will be under tension, and when relaxed will contract so that the length of the hose varies depending upon the amount of tension placed on the hose. Further, a tensioner assembly, generally indicated at 44, is provided for maintaining tension on the hose 42 so that the hose will not slacken, nor entangle with the vacuum pad assembly 36 as the latter is moved up and down the mast 26. The hose 42 is supported by the tensioner assembly 44 and has one end coupled to vacuum pump 40, and has its other end coupled to vacuum pad assembly 36. The hose is connected to the pump and vacuum pad assembly with conventional pneumatic fittings (not shown) in a manner well-known in the art.

The hose tensioner assembly 44 comprises a track assembly 46, slidable pulley assembly 48, fixed pulley 50, follower pulley 52 and biasing spring 54.

Track assembly 46 is supported by the body 20 and preferably secured to mast 26, and comprises identical mutually opposing tracks or ways 56 (see the breakaway portion in FIG. 1), extending generally in the vertical direction. Each track includes a groove 58 (only one of which is shown in the breakaway view in FIG. 1) extending the length of the track for guiding the movement of the slidable pulley assembly 48.

The slidable pulley assembly 48 includes a pair of guide blocks 60 (only one of which is shown in the breakaway view in FIG. 1) slidable in the respective grooves 58. The assembly 48 also includes the pulley 62, rotatably mounted between the pair of blocks, so as to be slidable therewith along the grooves for the entire length of the track assembly 46. A U-shaped bracket, generally indicated at 64, for supporting one end of the biasing spring 54 is coupled to the pulley 62 (specifically to the axle of the pulley within the space between the tracks 56 at opposite sides of the pulley). The biasing spring 54 biases the slidable pulley assembly 48 downwardly toward the bottom end of the tracks 56. The end of spring 54 opposite the bracket 64 is preferably secured to body 20 near the bottom end and the track assembly between the two tracks 56. The length and spring coefficient of the biasing spring 54 is selected so that the hose 42 is tensioned regardless of the position of the carriage assembly 30 on mast 26, as described hereinafter.

The tensioner assembly 44 also comprises the fixed pulley 50 rotatably mounted to mast 26 adjacent the top end thereof so that the rotation axis of pulley 50 is substantially parallel to the pulley 62 of assembly 44. The follower pulley 52 is also rotatably mounted adjacent the top end of mast 26 adjacent the fixed pulley so that the pulley 52 rotates parallel to the fixed pulley 50. Pulleys 48, 50 and 62 each have a circularly concave groove so as to each form a sheave sized so as to receive and frictionally engage the hose 42. The path of hose 42 extends downwardly from vacuum pump 40 to pulley 62 of the slidable pulley assembly 48, where the path of the hose substantially reverses directions so that the hose extends upwardly toward the fixed pulley 50 and follower pulley 52. The hose opposes the pulling force exerted on the pulley 62 by the biasing spring 54. The path of the hose is again substantially reversed by the fixed pulley 50 so that it extends downwardly toward vacuum pad assembly 36. Follower pulley 52 is provided to ensure that hose 42 remains in sliding engagement with fixed pulley 50. As shown in FIG. 2, the entire tensioner assembly is mounted on one side of the lift truck so as not to obstruct the view of the operator.

Turning now to FIGS. 1 and 2, vacuum pad assembly 36 is shown comprising an upper apron 66 and lower apron 68. Each of the aprons includes a curved plate 70, including a plurality of vacuum orifices 72 (FIG. 2), through which air is drawn from the outside through the plate so that the roll 34 can be pneumatically coupled to the aprons. The orifices 72 are pneumatically connected to vacuum plenums, indicated at 104 in FIG. 3, formed in the interior of each apron 66 and 68 (not shown in FIGS. 1 and 2). The plenums 104 are pneumatically coupled to hoses 74 which in turn are connected to accumulator tank 76. Accumulator tank 76 is provided for supplying a substantially instantaneous burst of vacuum pressure through the orifices 72 at the vacuum pad assembly 36, as described in greater detail hereinafter. Hose 42 is pneumatically coupled to accumulator tank 76, as indicated at 78. Upon activation of vacuum pump 40, atmospheric gases are drawn through orifices 72 of the plates 70 into the plenums behind the plates, and then into accumulator tank 76 from which they are evacuated with hose 42. Orifices 72 are distributed over the plates 70 so as to provide a substantially constant negative pressure over the entire outer surfaces of the plates.

Referring now to FIG. 2, peripheral pads or seals 80 are secured around the periphery of the outer surfaces of the plates 70 and dimensioned so as to mate with the surface of the roll 34 when the vacuum pad assembly 36 is brought into contact with the roll. The thickness of each of the seals 80 is selected so that a cavity is provided between the plates 70 and the outer surface of paper roll 34 when vacuum pad assembly 36 properly engages the paper roll. Actuating switches 82, preferably in the form of proximity switches, extend from the upper and lower plates 70 just beyond the respective curved surfaces defined by the outer edge of the corresponding seals 80 so that the switches are in the open position when the vacuum pad assembly 36 is not in contact with a roll, and are moved into the closed position when the assembly 36 is moved into contact with the roll 34. In addition, a pressure sensor 84 is disposed on each of the upper and lower plates for sensing the pressure adjacent the outer surface of the respective plates 70.

Referring to FIGS. 1 and 3, the vacuum system will be described in greater detail. The system includes the vacuum pump 40 for creating a vacuum of between about 16 to 29 inches of mercury, depending upon the type of paper used, with 22–29 inches being the preferred range for non-porous papers and 16–22 inches being the preferred range for porous papers. Preferably, pump 40 is mounted on support structure 90 secured to the roof 92 of the lift truck, as shown in FIG. 1. Rigid hose section 94 is connected between vacuum pump 40 and flexible hose 42. One portion of rigid hose section 94 is connected to one-way check valve 96 for insuring that atmospheric gases are drawn only through the hose into vacuum pump 40. Another portion of the hose section 94 is connected from the valve 96 to pressure sensor switch 98 for measuring the vacuum pressure inside the rigid hose and activating the electric motor 122 (shown and described in FIG. 4), which in turn drives the vacuum pump 40 when the pressure in the hose rises above a predetermined vacuum pressure level and deactivates the motor (which in turn deactivates the vacuum pump), when the pressure in the hose drops below a predetermined vacuum pressure level, all as described hereinafter with respect to FIG. 4.

The remaining portion of the rigid hose section is connected to the hose 42, which in turn is connected to a check valve 100 positioned at the connection between the hose 42 and the accumulator tank 76, so as to insure the presence of vacuum in the hose at all times during operation.

Accumulator tank 76 (FIGS. 1 and 3) is provided in the vacuum system for storing a quantity of air at vacuum pressure. Tank 76 is selectively pneumatically isolated from each of the upper and lower plates 70 of the vacuum pad assembly 36 by a pair of energizable solenoid valves **102*a* and 102*b*. When solenoid valves 102*a* and 102*b*are actuated, accumulator tank 76 is pneumatically coupled through the hoses 74 to the vacuum plenums 104 provided behind plates 70 in the vacuum pad assembly 36. Plenums 104 are in turn coupled to the orifices 72 of the respective plates 70. When the solenoid valves 102 are open by the proximity switches 82, a substantially instantaneous burst of vacuum pressure is provided to the front surface of the plate 70 within each corresponding seal 80 of the apron. A second pair of solenoid valves 105*a* and 105*b* are mounted on vacuum pad assembly 36 so as to be pneumatically coupled with the face 70 thereof. When actuated, solenoids 105*a* and 105*b* allow ambient pressure to enter the cavity between roll 34 and pad assembly 36. An air filter 106 is provided between the plates 70 and the solenoid valves 102 so that any particulate matter, such as paper dust drawn into the vacuum system through the orifices 72, is removed. Preferably, the filter medium (not shown) of the filter is selected to remove particulates of a size large enough to harm the solenoid valves 102, check valves 96 and 100, vacuum pump 40, and other elements of the vacuum system. The filter 106** may be designed to readily permit periodic replacement of the filter medium.

Figure 4:
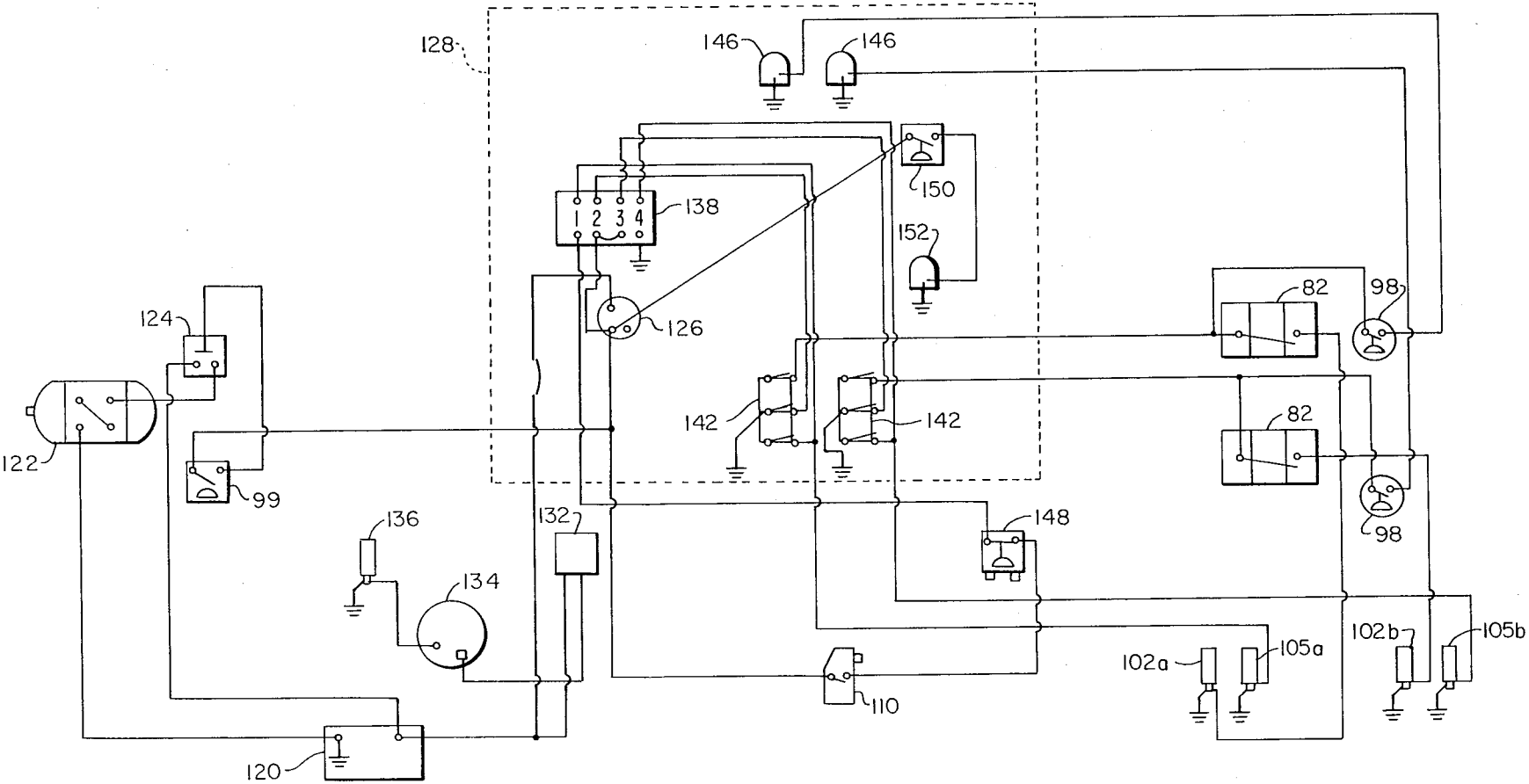
FIG. 4 is a schematic view of the electrical system of the truck shown in FIG. 1.

In FIG. 4, the preferred electro-mechanical system of the lift truck of the present invention is described for controlling the position of the vacuum pad assembly, and the application of the vacuum to the roll 34. The system includes a power source, such as a single twelve volt deep discharge battery 120 when non-porous paper is being moved, or a pair of series-connected twelve volt deep discharge batteries when porous paper is being moved. The ground terminal (cathode) of battery 120 is connected to the ground terminal of the DC electric motor 122, which in turn has its positive terminal connected to the relay 124, which in turn is connected to the anode of the battery 120. The relay 124 is also connected and responsive to the pressure sensor switch 99, which in turn is connected to the system side of the ignition switch 126 provided in the control box 128, the latter being provided in the truck so as to be easily accessible to the operator. The battery side of the ignition switch 126 is connected through the fuse 130 to the anode of the battery 120 and to the voltage regulator 132. The regulator 132 is, in turn, connected the alternator 134, which in turn is connected to the solenoid 136.

The system side of the ignition 126 is also connected to the relays 2 and 3 of relay box 138, as well as the grip switch 110, also controlled by the operator. Relays 2 and 3 of the box 138 are connected to the corresponding pad selector switches 142 for selectively controlling the application of vacuum to the upper and lower plates 70. Switches 142 are each coupled to the actuator switches 82 of the upper and lower aprons, and to the corresponding solenoid valves 102 for the corresponding upper and lower aprons. The pad selector switches thus couple the corresponding actuating switch with the solenoids of the corresponding apron so that vacuum is applied to the apron when the pad selection and the actuating switches are both closed. The switches 142 can also be connected to pressure sensor switches 98, preferably in the form of microswitches, which in turn are connected to lights 146 so as to indicate to the operator when and which lines of vacuum are activated so as to determine when the vacuum seal is obtained between each of the upper and lower aprons and the paper roll 34.

Solenoid valve **105*a* is connected to system ground through the relay 4, while valve 105*b* is connected to system ground through relay 1 of the relay box 138. Relay 1 is, in turn, connected to the hydraulic pressure switch 148 for measuring the pressure of the hydraulic fluid used to lift the carriage assembly 30 on the mast 26. Specifically, switch 148 is adapted to remain open so long as the hydraulic pressure of the fluid is above some predetermined minimum level, indicating that the paper roll is supported by the pad assembly 36 off the ground. The switch will close when the roll is placed on the ground and the hydraulic pressure then drops. Switch 148 is connected to the grip switch 140 so that when the switch 148 is closed the roll can be released by closing the grip switch, which in turn opens the solenoids 105 and closes solenoids 102**.

Finally, vacuum switch 150, connected to the system side of ignition 126, is, in turn, connected to the light indicator 152. Both switch 150 and indicator 152 operate when the vacuum level falls below the level corresponding to the minimum vacuum pressure needed by the vacuum assembly 36 to support the paper roll 34.

In operation, ignition switch 126 is closed connecting the switch to power from battery 120. So long as the vacuum pressure in the vacuum system is below the level needed for vacuum pad assembly 36 to support the weight of paper roll 34, vacuum sensor switch 99 is closed thereby connecting electric motor 122 to the battery power. When powered, electric motor 122 drives vacuum pump 40 creating a negative pressure in the vacuum system. When sufficient vacuum pressure is generated for supporting paper roll 34, vacuum sensor switch 99 opens, deactivating electric motor 12.

To lift a paper roll 34 having a height greater than the height H (see FIG. 2) of the vacuum pad assembly 32, both rocker switches 142 are closed. (When the roll is only high enough to be supported by a single apron, only the corresponding rocker switch 142 is closed.) The closed ignition switch 126 will also close relays 1, 2, 3 and 4 of the relay box 138, in an actuation mode, wherein both aprons of the pad assembly will be actuatable, as will be indicated by the illumination of both lights 146. (Where only a single rocker switch 142 is closed, only a single apron of the pad assembly is actuable.) Vacuum pressure is supplied to the vacuum pad assembly 36 upon engagement of actuating switches 82 with the outside surface of paper roll 34. No other overt action is required on the part of the operator to couple vacuum pad assembly 36 to a supply of vacuum pressure other than moving the vacuum pad assembly into contact with paper roll 34 so that a vacuum is created in the space between the plates 70 and the roll and within the corresponding seal 80. In the event sensors 98 detect that the vacuum coupling between vacuum pad assembly 32 and paper roll 34 is not made, lights 146 will not be illuminated and light 152 will be illuminated. By this illumination configuration, the lift truck operator is alerted not to attempt to lift a paper roll 34. When sufficient vacuum pressure exists in the vacuum system for paper roll transport, lights 146 are illuminated and light 152 is extinguished.

When it is desired to release a paper roll 34, the operator closes grip switch 140. If the roll is not self-supporting, the weight of the roll will be sufficient to raise the hydraulic pressure so that the hydraulic pressure switch 148 will disconnect the grip switch 140. If the operator closes the grip switch 140 when the system is in this condition, nothing will happen, creating the safety feature of preventing accidental or premature release of the roll 34 before it can completely support itself. If the roll 34 is self-supporting, the hydraulic switch 148 will close, and the paper roll will be released when the operator closes the grip switch 140.

The truck shown and described has several advantages over the prior art systems. The check valves 96 and 100 insure that the vacuum is maintained in the hose 42, and together with the solenoid valves 102 and vacuum plenum, enable the vacuum to be maintained and quickly delivered to the front end vacuum pad assembly 36 so as to (a) reduce the lag time required to establish a sufficient vacuum coupling between the vacuum pad assembly 36 and the load 34 and (b) hold the load 34 when it is lifted and transported. Further, by using the pressure sensor switch 98, a fast response time is provided to build sufficient negative pressure between the vacuum pad assembly 36 and the load 34 without the need to operate the vacuum pump continuously. As a result, when the switches 82 come into contact with the roll 34 and close, the vacuum is applied subtantially instantaneously, without any other overt act on the part of the operator. The use of the switch 99 and valve 124 results in the vacuum pump 40 only activating when the negative pressure in the vacuum system drops below a first threshold level and deactivating when the negative pressure exceeds a second threshold level. The accordian-like spring hose 42 and the hose tensioner assembly 44 do not require a heavy counterweight and provide better visibility for the operator.

Since certain changes may be made in the above apparatus without departing from the scope of the invention herein involved, it is intended that all matter contained in the above description or shown in the accompanying drawings shall be interpreted in an illustrative and not in a limiting sense.

What is claimed is:

1. A lift truck for transporting a load, said truck comprising:

a frame;

a plurality of rotatable wheels coupled to said frame;

a mast secured to said frame;

a carriage secured to and movable relative to said mast;

load engagement means secured to and movable with said carriage relative to said mast for engaging and holding said load, said load engagement means including vacuum pad means and pneumatic switching means, said vacuum pad means being configured and said pneumatic switching means being positioned so that when said vacuum pad means is moved into contact with and engages said load so as to activate said penumatic switching means a vacuum coupling is created between said vacuum pad means and said load, said vacuum coupling being of sufficient strength so as to permit said vacuum pad means to support the weight of said load;

vacuum pump means secured to said truck for selectively creating a vacuum pressure sufficient to provide said vacuum coupling; and hose assembly means for pneumatically coupling said vacuum pad means with said vacuum pump means, said hose assembly comprising a flexible hose extending between said vacuum pump means and said vacuum pad means, said flexible hose having a first end in pneumatic communication with said vacuum pump means and a second end in pneumatic communication with said vacuum pad means and hose tensioner means for engaging said flexible hose so as to prevent slack from developing in said hose as said carriage is moved relative to said mast, wherein said hose tensioner means comprises:

means for defining an elongated track secured to said frame;

first pulley means including a first pulley mounted for rotation about its pulley axis and slidably movable along said track in a direction substantially perpendicular to said pulley axis, said first pulley being adapted to engage and support said hose so that the path of said hose is translated from a first direction to a second direction as said hose travels over said first pulley;

second pulley means including a second pulley mounted to said mast for rotation about its pulley axis, said second pulley being adapted to engage and support said hose so that the path of said hose is translated from said second direction to a third direction as said hose travels over said second pulley; and resilient biasing means coupled between said first pulley and said means for defining said track for moving said first pulley along said track as said carriage moves relative to said mast so as to maintain tension on said hose.

2. A lift truck according to claim 1, wherein said resilient biasing means comprises a coil spring.

3. A lift truck according to claim 1, further comprising third pulley means rotatably mounted to said mast for ensuring said hose remains engaged with said second pulley as said carriage is moved along said mast.

4. A lift truck according to claim 1, further wherein:

said means for defining said elongated track comprises a pair of axially extending grooves formed to face one another; and said first pulley means comprises (a) a pair of guides each being slidably disposed within a corresponding respective one of said grooves and (b) means for rotatably supporting said first pulley by said pair of guides.

5. A lift truck according to claim 1, wherein said vacuum pad means includes face plate means including a plurality of apertures through which said vacuum pressure can be applied and adapted to cooperate with said pneumatic switching means so that atmospheric gases are drawn through said apertures in the creation of said suction coupling when said pneumatic switching means moves into contact with said load.

6. A lift truck according to claim 5, wherein said vacuum pad further comprises:

a vacuum seal means secured to said face plate means so as to extend continuously about a peripheral portion of said face plate means.

7. A lift truck according to claim 5, wherein (a) said vacuum pad means comprises vacuum seal means mounted on said face plate means for sealingly engaging said load so as to permit creation of said vacuum coupling between said vacuum pad means and said load, said vacuum seal means being configured so that a cavity is created between said face plate means and said load when said vacuum seal means engages said load, said cavity being pneumatically coupled to said hose assembly means; and (b) said truck further comprises (i) first vacuum sensor means pneumatically connected to said cavity for detecting the vacuum pressure in said cavity, said first vacuum sensor means being in a first state when the vacuum pressure in said cavity is below the level necessary to achieve said vacuum coupling and a second state when the vacuum pressure in said cavity is above the level necessary to achieve said vacuum coupling and (ii) operating state illumination means coupled to said first vacuum sensor means for indicating when said first vacuum sensor means is in said first state and when said first vacuum sensor means is in said second state.

8. A lift truck according to claim 7, further comprising:

second vacuum sensor means pneumatically coupled to said hose assembly means for activating said vacuum pump means when a first negative pressure level is reached and for deactivating said vacuum pump means when a second negative pressure level is reached.

9. A lift truck according to claim 8, further comprising control means coupled to said vacuum pump means for selectively actuating said vacuum pump means, said control means comprising:

conduit means for pneumatically coupling said accumulator tank means with said vacuum pad means;

first electro-magnetic means in pneumatic communication with said conduit means for automatically coupling said accumulator tank means to said vacuum pad means upon engagement of said vacuum pad means with said load whereby said vacuum pad means is substantially instantaneously coupled to a source of vacuum pressure; and second electro-magnetic means for breaking said suction coupling between said vacuum pad means and said load, said second electro-magnetic means having a switch adapted to actuate said second electro-magnetic means so as to break said suction coupling.

10. A lift truck according to claim 9, further comprising sensing means connected to said second electro-magnetic means for preventing actuation of said second electro-magnetic means when said carriage structure is positioned on said mast so that a load supported by said vacuum pad assembly does not rest on the ground.

11. A lift truck according to claim 9, further comprising filter means pneumatically coupled between said first electro-magnetic means and said vacuum pad means for removing foreign matter drawn by said vacuum pump means from said vacuum pad means.

12. A lift truck according to claim 11, said filter means comprising:

a disposable filter element;

a filter housing for containing said filter element, said filter housing being adapted to permit ready replacement of said filter element.

13. A lift truck according to claim 1, further comprising:

accumulator tank means pneumatically coupled between said vacuum pump means and said vacuum pad means for storing a quantity of vacuum pressurized air; and conduit means for pneumatically coupling said accumulator tank means with said vacuum pad means.

14. A lift truck according to claim 1, wherein (a) said vacuum pad means comprises a plurality of face plate means coupled together so as to cooperatively support said load and a like plurality of vacuum pads respectively supported by said plurality of face plate means, and (b) said pneumatic switching means comprises a plurality of pneumatic switches each associated with a corresponding respective one of said plurality of vacuum pads.

15. A lift truck according to claim 1, further comprising control means coupled to said vacuum pump means for selectively actuating said vacuum pump means, said control means comprising:

conduit means for pneumatically coupling said accumulator tank means with said vacuum pad means;

electro-magnetic coupling means in pneumatic communication with said conduit means for automatically coupling said accumulator tank means to said vacuum pad means upon engagement of said vacuum pad means with said load whereby said vacuum pad means is substantially instantaneously coupled to a source of vacuum pressure; and electro-magnetic decoupling means for breaking said suction coupling between said vacuum pad means and said load, said decoupling means having a switch adapted to actuate said decoupling means so as to break said suction coupling.

16. A lift truck according to claim 15, further comprising sensing means connected to said decoupling means for preventing actuation of said decoupling means when said carriage structure is positioned on said mast so that a load supported by said vacuum pad assembly does not rest on the ground.

17. A lift truck according to claim 15, further comprising filter means pneumatically coupled between said coupling means and said vacuum pad means for removing foreign matter drawn by said vacuum pump means from said vacuum pad means.

18. A lift truck according to claim 17, wherein said filter means comprises:

a disposable filter element;

a filter housing for containing said filter element, said filter housing being adapted to permit ready replacement of said filter element.

* * * * *